US005201631A

United States Patent [19]

Ringot et al.

[11] Patent Number: 5,201,631

[45] Date of Patent: Apr. 13, 1993

[54] PROCESS FOR PROTECTING A LOAD RECEIVING PLANE

[75] Inventors: Jean-Marc Ringot, Carnin; Henri Sauvaige, Lille, both of France

[73] Assignee: Societe Anonyme: Cartonneries de la Lys-Ondulys, Lomme, France

[21] Appl. No.: 754,602

[22] Filed: Sep. 4, 1991

[51] Int. Cl.[5] ..... B65D 19/00

[52] U.S. Cl. ..... 414/786; 108/51.1; 414/799; 414/789.6

[58] Field of Search ..... 414/791.2, 789.5, 786, 414/789.6, 799, 791.6, 792; 108/55.1, 51.1

[56] References Cited

U.S. PATENT DOCUMENTS

| | | | |
|---|---|---|---|
| 1,840,971 | 1/1932 | Polk | 108/51.1 |
| 1,993,237 | 3/1935 | Barrett | 108/51.1 |
| 2,576,715 | 11/1951 | Farrell | 108/55.1 X |
| 3,531,855 | 10/1970 | Spring, Jr. | 108/51.1 X |
| 3,884,363 | 5/1975 | Ajlouny | 414/792 X |
| 4,242,024 | 12/1980 | Buta et al. | 414/799 X |
| 4,552,499 | 11/1985 | Foust et al. | 414/789.5 X |
| 4,927,318 | 5/1990 | Hayden et al. | 414/791.6 |
| 4,984,963 | 1/1991 | Bon | 414/799 X |
| 4,986,726 | 1/1991 | Benuzzi et al. | 414/799 X |
| 4,989,853 | 2/1991 | Matysek et al. | 414/791.2 |

FOREIGN PATENT DOCUMENTS 0156012 10/1985 European Pat. Off. .

*Primary Examiner*—David A. Bucci
*Assistant Examiner*—James T. Eller, Jr.
*Attorney, Agent, or Firm*—Sandler, Greenblum & Bernstein

[57] ABSTRACT

The invention relates to a process for the protection of a load receiving plane, such as the platform of a handling pallet, as well as to a device for implementing the process. It will find an application most especially with the constructors of automatic handling equipment, such as automated palletizing installations.

The surface of the receiving plane (7) is covered with successive deposits of modular protective sheets (8, 10, 11 and 12) which overlap one another in varying degrees.

12 Claims, 2 Drawing Sheets

PROCESS FOR PROTECTING A LOAD RECEIVING PLANE

BACKGROUND OF THE INVENTION

1. Field of the Invention

The invention relates to a process for protecting a load receiving plane such as, in particular, the platform of a handling pallet, as well as to a device for implementing the process. It will quite especially find an application with the manufacturers of automatic handling equipment, such as automated palletizing installations.

2. The Prior Art

In numerous industries, manufactured products are generally packed on pallets. This facilitates the handling operations as pallets can be manipulated conveniently with the help of fork lift trucks. Under these circumstances, lorries can be loaded and unloaded very quickly and the products can be stored in store rooms fitted with racks in which the loaded pallets are stowed.

There exist different formats of pallets used to suit as well as possible the dimensions and goods to be placed thereon. In practice, the dimensions range from formats of 800 mm×800 mm to 1,600 mm×1,600 mm.

Automatic palletizing installations are also known. Their role is to ensure the loading of the goods onto pallets via a processing line. For this purpose, the installations include a linear conveyor to supply empty pallets, and are supplied with the packages to be loaded onto the pallets.

By means of a system for gripping the packages, known to a man of the art, such as, for example, a vacuum sucker or other means, the packages are manipulated from a supply track to the platform of the pallet to be loaded. Once loading is completed, the pallet is directed by the linear conveyor to a store or a loading area. These installations make it possible to operate continuously and at fast rates.

However, certain more or less fragile goods cannot be loaded directly onto the platform of the pallet. The latter is, in fact, made up of nailed wooden boards having a rough appearance.

In addition, there can be nailing defects, in which case nail points are present on the surface. As a result, in certain applications, it is essential to cover the load receiving plane, and particularly the platforms of the pallets, with a protective screen, before depositing a load thereon. This protective screen is generally known in French as a 'macule', or protective sheet, and currently takes the form of a sheet of corrugated cardboard more or less adapted to the dimensions of the pallet by the warehouseman.

In automatic palletizing installations, the protective sheet is installed in a work station located upstream of the loading area. This operation is performed manually as, in addition to installation properly speaking on the platform of the pallet, it is also necessary to dimension the protective sheet.

Indeed, many automatic palletizing installations have cause to work on different pallet formats depending on the loads to be placed thereon. Under these conditions, an appropriate protective sheet has to be put in place on each pallet format. An operator is thus responsible for installing protection corresponding to the format of the pallets.

Not only is this operation costly as regards labour but it is also necessary to have different protective sheet formats available to meet different requirements. This being the case, a major shortcoming is encountered in automated palletizing installations capable of operating with different pallet formats in which the platforms have to be protected by a protective sheet.

SUMMARY OF THE INVENTION

The main object of the present invention is to provide a process for protecting a load depositing surface, designed, for example, for automated palletizing installations, which permits full automation of the process, while at the same time being capable of adapting to different pallet formats. A twofold savings is to be noted: in respect of labour and in that of the standardization of the protective sheets for which there can be a single format.

According to the invention, it is possible, for example, to cover a very wide range of pallets extending, in particular, from the 800 mm×800 mm to the 1,600 mm×1,600 mm format, i.e., the whole range of dimensions most commonly encountered. However, other dimensions can also be contemplated.

However, the present invention could also be applied in a centralized palletization handling installation.

The device that enables the process of the present invention to be implemented accomodates continuous operation as the station can be integrated at the point of supply of an automated palletizing installation. For example, the device according to the invention can be interposed between the station at which the pallets are loaded onto the linear conveyor and the automatic palletizing installation. In which case, the pallets sent to the installation already have their platforms covered with a protective sheet of the appropriate format.

One of the main advantages deriving from the present invention is the use of a single protective sheet format, whatever the dimensions of the pallet to be covered. This reduces stock and cuts costs. It should be stressed in this connection that the process according to the present invention makes it possible to cover continuously all the formats existing between the two extremes: generally 800 mm×800 mm and 1,600 mm×1,600 mm.

Further objects and advantages of the present invention will emerge in the course of the description that follows, which is only provided, however, by way of example.

According to the invention, the process for protecting a load receiving plane such as, in particular, the platform of a handling pallet, is characterized in that the surface of the depositing plane is covered by successive deposits of modular protective sheets which more or less partially cover one another.

The device permitting the implementation of the invention is characterized by the fact that it includes a motorized linear conveyor and a loader, disposed at the conveyor and transversely mobile in relation to the conveyor, the displacements whereof are commanded and controlled.

The invention will be more readily understood upon studying the following description accompanied by the annexed drawings, wherein:

THE DRAWINGS

FIG. 1 illustrates a pallet loaded with packages, an intermediate protective sheet being placed between the pallet and the load, FIG. 2 schematically represents the device according to the present invention constituted by a linear pallet conveyor and a protective sheet loader, according to one embodiment, FIGS. 3*a*, *b*, *c* and *d* represent respectively the different phases in the process for protecting the surface of a pallet platform, in top view, by way of example, FIG. 4 shows the preferred direction of depositing of the rows of protective sheets on the surface of the pallet platform.

DESCRIPTION OF THE PREFERRED EMBODIMENT

The present invention relates to a process for protecting a load receiving plane such as, in particular, the platform of a handling pallet, as well as to a device for implementing the process. It is designed for the constructors of automatic handling equipment and, in particular, palletizing installations.

The storing of manufactured products on pallets is increasingly commonplace. Certain fragile products cannot, however, be placed directly on the platform of the pallet, the surface of which can cause damage. In this case, it is necessary to place a protective screen between the load and the pallet. This protective screen is generally known in French as a 'macule', or protective sheet, which takes the form of a sheet of corrugated cardboard the format of which substantially corresponds to that of the platform of the pallet.

In automatic palletizing installations, i.e., when the product is installed on the pallet using automatic gripping means, the installation of the protection must be automated. However, this latter requirement is not always met. Indeed, the formats of the pallets can vary, and, in general, range between 800 mm×800 mm to 1,600 mm×1,600 mm. When the formats vary, it is no longer possible to operate automatically as, for each pallet dimension, it is necessary to install a protective sheet of a given pre-cut format.

At present, human intervention is required to install protection of suitable dimensions on the platform of the pallet. It is precisely this manual intervention that impedes full automation of palletization that the invention proposes to eliminate.

Figure 1:
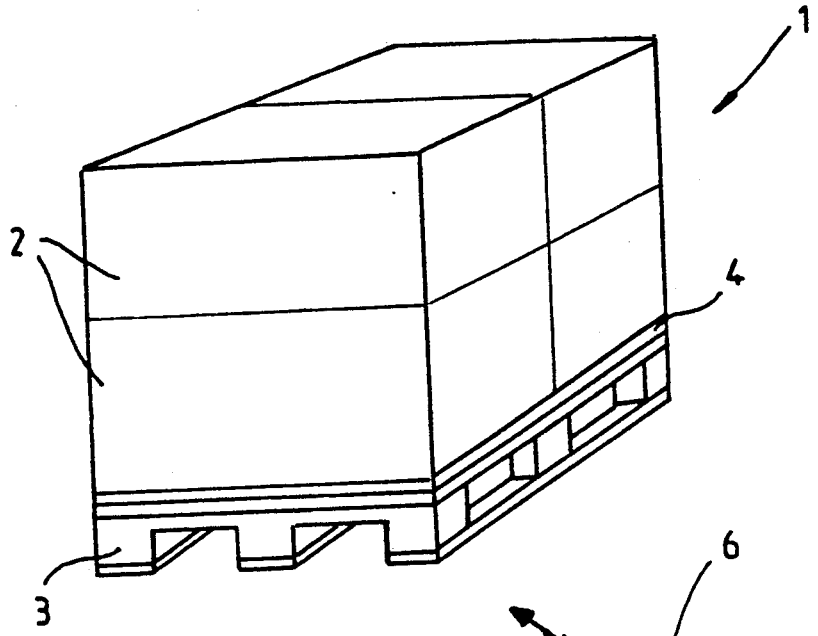

FIG. 1 represents a palletized load 1; in the example chosen, the load takes the form of packages 2 stacked on a pallet 3. The pallet in question is a standard four-way pallet composed of a platform raised on skids constituting the load receiving plane. The traditional pallets are generally made of wood; however, it is perfectly possible to use any other material.

A protective screen or 'macule' 4 is placed between the packages 2 and the platform of the pallet 3 to protect the load. Traditionally, the protective sheet is made from a cardboard sheet in such a way that its dimensions cover the surface of the upper platform of pallet 3.

By contrast with present techniques, wherein use is made of a protective sheet the format of which corresponds to that of the pallet, according to the process for protecting the receiving plane according to the present invention, such as that notably defined by the platform of pallet 3, use is made, to cover the surface of the latter, of several modular protective sheets, the unit dimensions of which are less than those of the platform.

For this purpose, the surface of the pallet is notably covered by successive deposits of modular protective sheets which more or less overlap. By exploiting the number of modular protective sheets used and the degree of overlap thereof, it is possible to vary the dimensions of the protective surface created by the installation of the modular protective sheets. In this way, it is possible to adapt, in particular, to the different pallet formats encountered.

For example, with a single given dimension of modular protective sheet and by appropriately superposing four sheets, it is possible to cover a multiplicity of pallet dimensions, whether standard or special.

Figure 2:
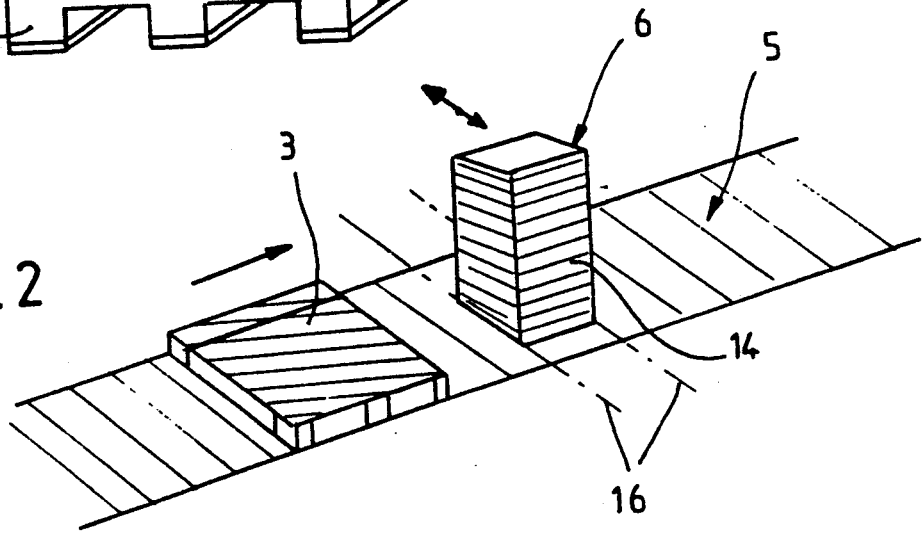

For the purpose of integration in an automatic palletizing installation, the device according to the present invention includes a motorized linear conveyor 5, such as illustrated in FIG. 2, on which the pallets 3 can travel from a pallet loading station to the pallet supply area of the palletizing installation. Linear conveyor 5 can be of the motor roller or of the endless belt type, and its movements are commanded and controlled.

In addition, the device includes a loader 6, provided at the linear conveyor and mobile transversely in relation to the latter, 5.

Loaders are apparatus known to a man of the art and are composed of a magazine 14 in which the modular protective sheets are kept stacked. At the base of the loader, a stack locking mechanism can be used, when actuated, to release one protective sheet at a time; such mechanisms are known to the man of the art. According to the present invention, the loader is mounted on a devic, for example, fitted with skids, diagrammatically represented at 16 in FIG. 2, so that it can be displaced transversely, this transverse displacement, like that of conveyor 5, being commanded and controlled.

Thus, to permit the automatic application of the load protecting process according to the present invention, in particular of the platform of a pallet 3, it is possible to adjust transverse positioning of a modular protective sheet at the time of depositing by displacing loader 6, while the longitudinal positioning of the modular sheets can be determined by controlling the linear conveyor.

According to one implementation of the process according to the invention, from loader 6, there are deposited, widthwise on the platform of pallet 3, at least two modular protective sheets which overlap through transverse displacement of loader 6, according to the width of the receiving plane and the size of the modular protective sheets. Pallet 3 is then advanced on the linear conveyor, and a further series of modular protective sheets is then placed widthwise, partially covering those previously put in place.

Thus, by successively depositing protective sheets, it is possible to cover any length and width of receiving plane. In other words, a single dimension of modular protective sheet can be used to cover any size of receiving plane.

Preferably, four modular sheets will be used to cover the entirety of the surface of the receiving plane according to the following procedure, illustrated in FIGS. 3*a* to 3*d*.

Figure 3A:
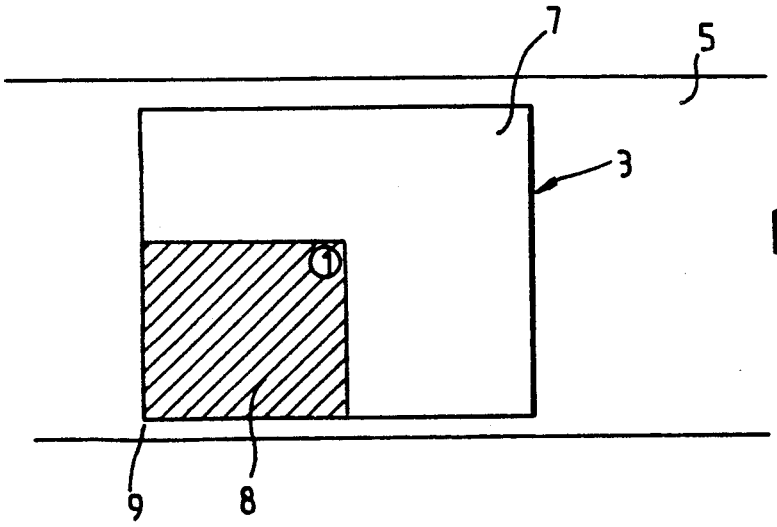

Let us assume that the surface of platform 7 of pallet 3 is to be covered. To do this, pallet 3 is advanced on linear conveyor 5 and loader 6 is positioned widthwise in such a way that a first protective sheet 8 is placed on pallet 3 with one of corners 9 of protective sheet 8 coinciding substantially with the corner of platform 7, as illustrated in FIG. 3*a*.

Figure 3B:
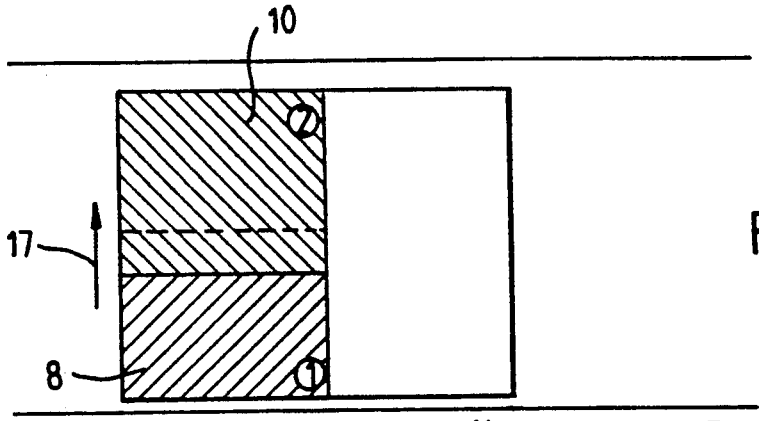

Then, loader 6 is displaced transversely, this being simulated by arrow 17, by a distance equal to the difference between the format of protective sheet 8 and the width of platform 7, and a second sheet 10 is deposited, as illustrated in FIG. 3*b*.

Figure 3C:
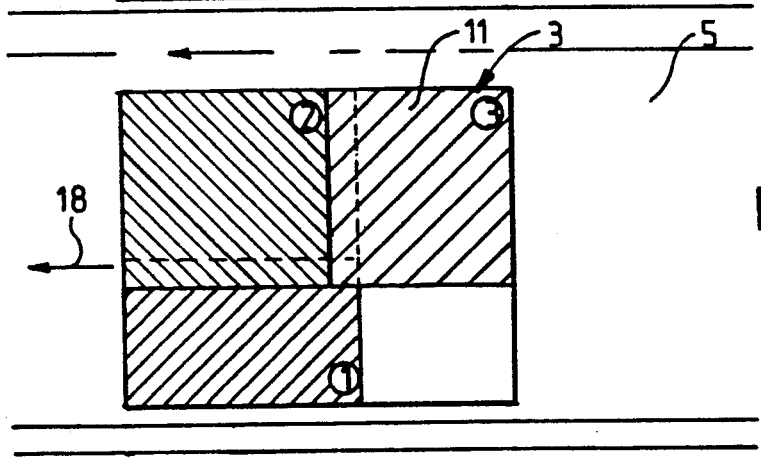

Next, pallet 3 is advanced on linear conveyor 5, this being simulated by arrow 18, by a length equal to the difference between the format of one protective sheet and the length of the platform 7, and a third protective sheet 11 is put in place, as illustrated in FIG. 3*c*.

Figure 3D:
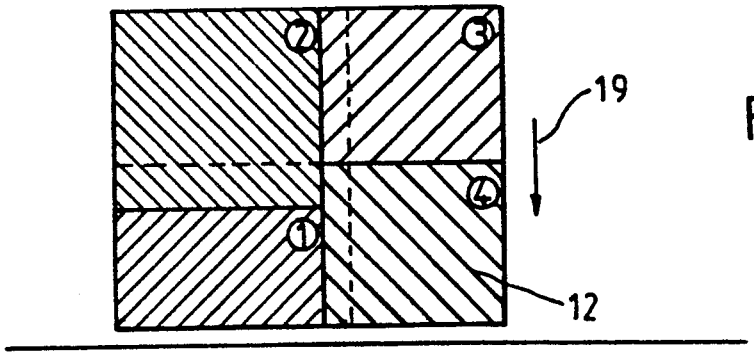

Finally, loader 6 is displaced transversely, as simulated by arrow 19, by a distance equal to the difference between the format of a protective sheet 8 and the width of the platform in order to deposit a fourth protective sheet 12, as illustrated in FIG. 3*d*. It should be stressed that, in this latter position, loader 6 has regained its initial transverse position in relation to the depositing operation of FIG. 3*a*.

As can be seen, the totality of surface 7 of the platform is covered with modular protective sheets (8, 10, 11, 12) which overlap.

Tests have shown that, in order to ensure that the protective sheets remain firmly in place, it is advantageous for the overlap to be at least a few centimeters, for example 5 cm.

In the example chosen, it was attempted to cover the surface of platform 7 of pallet 3 very precisely. However, in certain applications, it is desirable to cause the protection to project slightly beyond the platform of the pallet so that, once the load has been deposited, flaps can be obtained all around the load, as suggested in FIG. 1, so that the installation of strapping around the load does not damage it.

In order to place the protective sheets in such a way that they project from platform 7 of the pallet, it suffices to adjust the process as if it were proposed to cover a platform of a pallet of larger dimensions than the one actually involved.

Although, hitherto, it has always been contemplated depositing modular protective sheets directly on the surface of the pallet platforms, in certain automatic centralized palletizing installations, the sheets will be installed directly on the linear conveyor 5. The process remains identical and protective sheets are deposited so as to create a protective surface on which the load will then be deposited.

In such installations, installation on pallets is to be carried out in a subsequent operation in which the load placed on the protective sheet is transferred to the pallet. With these installations, it is important to deposit the successive rows of modular protective sheets on the preceding rows in order to avoid any risk of catching during transfer.

Figure 4:
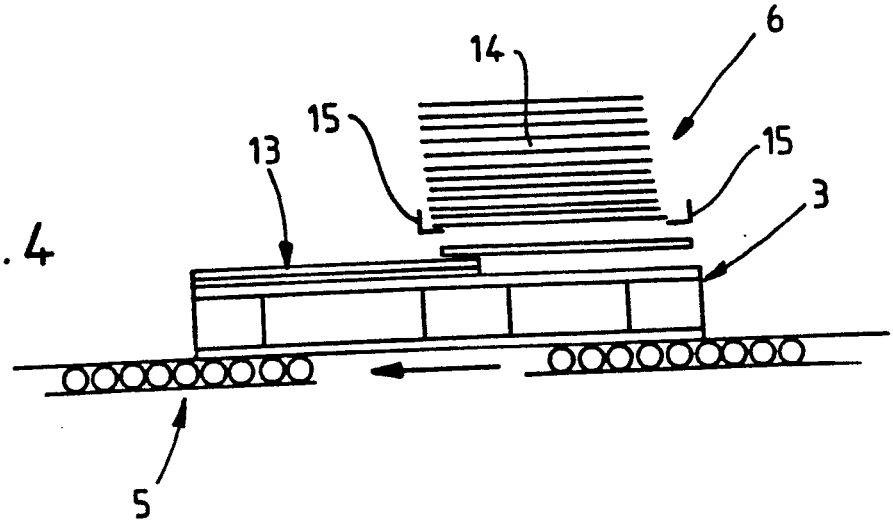

In particular, to reduce the risk of the sheets catching during transport to pallet 3, it is desirable to place the first row of protective sheets 13 at the front of pallet 3, as illustrated in FIG. 4 in relation to the advance of the pallet.

The modular protective sheet receiving device for implementing the process, as illustrated in FIG. 2, preferably uses for the purpose of operating linear conveyor 5, one or more controlled motors, which makes it possible to ensure precise positioning beneath loader 6. Positioning accuracy can also be enhanced by using a non-skid coating at the linear conveyor 5 in the zone located below loader 6.

Further, as regards control of the lateral displacement of loader 6, use can advantageously be made, for example, of a pneumatic jack. Nonetheless, other types of control device, within the reach of a man of the art, could also be used.

Positioning control can be ensured, for example, using a micro-computer or a programmable automaton that will act on the piloted motors in accordance with the load to be placed on the pallets and their format.

In the case of the most traditionally used pallets, i.e., those the format of which ranges from 800 mm×800 mm to 1,600 mm×1,600 mm, it may be advantageous to use a single size of standard modular protective sheet, of approximately 800 mm×800 mm; this will make it possible to cover the full range of formats liable to be encountered.

Other embodiments of the present invention, within the reach of a man of the art, could likewise have been contemplated without thereby departing from the scope thereof.

What is claimed as new is:

1. Process for protecting a surface of a load receiving plane, comprising:

covering the surface of the load receiving plane with a plurality of modular protective sheets by successively depositing the plurality of modular protective sheets on the surface of the load receiving plane so that adjacent edges of the modular protective sheets overlap;

said step of successively depositing the plurality of modular protective sheets comprising:

depositing with a loader a first protective sheet of at least two modular protective sheets on the surface of a linear conveyor, advancing the loader in a transverse direction at least one more time and depositing at least one further of the at least two modular protective sheets with an edge overlapping the first protective sheet, advancing the linear conveyor and depositing a protective sheet of at least two additional modular protective sheets with an edge overlapping at least one adjacent edge of the at least two modular protective sheets, and transversely advancing the loader at least one more time and depositing at least one further of the at least two additional modular protective sheets with at least one edge overlapping adjacent edges of modular protective sheets.

2. The process according to claim 1, wherein the load receiving plane comprises a pallet having a platform.

3. The process according to claim 2, comprising depositing a first modular protective sheet on the platform of the pallet with one corner of the modular protective sheet substantially coinciding with a first corner of the platform, transversely displacing the loader a first distance and depositing a second modular protective sheet so that one corner of the second modular protective sheet substantially coincides with a second corner of the platform and the first and second modular protective sheets have overlapping adjacent edges, advancing the linear conveyor to advance the pallet a second distance and depositing a third modular protective sheet so that one corner of the third modular protective sheet substantially coincides with a third corner of the platform and the third modular protective sheet overlaps adjacent edges of the first and second modular protective sheets, and transversely displacing the loader a third distance and depositing a fourth modular protective sheet so that one corner of the fourth modular protective sheet substantially coincides with a fourth corner of the platform and the fourth modular protective sheet overlaps adjacent edges of the first, second and third modular protective sheets.

4. The process according to claim 3, wherein each of the plurality of protective sheets has substantially equivalent dimensions.

5. The process according to claim 4, wherein each of said plurality of modular protective sheets is about 800 mm×800 mm.

6. The process according to claim 2, wherein the modular protective sheets are deposited to project over the platform of the pallet.

7. The process according to claim 2, wherein a first modular protective sheet is deposited at the front of the load receiving plane in relation to direction of advance of the linear conveyor.

8. The process according to claim 2, wherein each of the plurality of protective sheets has substantially equivalent dimensions.

9. The process according to claim 8, wherein each of said plurality of modular protective sheets is about 800 mm×800 mm.

10. The process according to claim 1, wherein the modular protective sheets are deposited to project over the load receiving plane.

11. The process according to claim 1, wherein each of the plurality of protective sheets has substantially equivalent dimensions.

12. The process according to claim 11, wherein each of said plurality of modular protective sheets is about 800 mm×800 mm.

* * * * *